US006309045B1

(12) United States Patent
Suzuki et al.

(10) Patent No.: US 6,309,045 B1
(45) Date of Patent: Oct. 30, 2001

(54) PRINTER CARRIAGE WITH CONFIGURATION TO INSURE PROPER DETECTION OF INK CARTRIDGE

(75) Inventors: Hiroshi Suzuki; Noriyuki Yamada, both of Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/221,993

(22) Filed: Dec. 29, 1998

(30) Foreign Application Priority Data

Jan. 7, 1998 (JP) ..... 10-013313

(51) Int. Cl.[7] ..... B41J 23/00
(52) U.S. Cl. ..... 347/37; 347/19
(58) Field of Search ..... 347/37, 49, 19, 347/86, 87, 50; 399/13

(56) References Cited

U.S. PATENT DOCUMENTS 4,736,213 * 4/1988 Piatt et al. ..... 347/49
5,311,253 * 5/1994 Ohmori et al. ..... 399/13
5,867,188 * 2/1999 Murayama et al. ..... 347/37
5,963,225 * 10/1999 Sugiyama ..... 347/19

FOREIGN PATENT DOCUMENTS

A-7-246716 9/1995 (JP) .

* cited by examiner

*Primary Examiner*—John Barlow
*Assistant Examiner*—Craig A. Hallacher
(74) *Attorney, Agent, or Firm*—Oliff & Berridge, PLC

(57) ABSTRACT

When a clamp lever 40 is pivoted in a direction of arrow F1, and a hook 41*c* of a hook lever 41*b* is engaged in an engagement hole 35*a*, then a switch lever provided at a front end of the clamp lever 40 pivots in a counterclockwise direction and a lower surface of a front end 42*b* of the switch lever presses down a button 61*a* of a detection switch 61. Also the upper surface of the 50*a* of the ink cartridge 50 is pressed by the plate spring 44 provided to the under surface of the clamp lever 40 so that the ink cartridge 50 is mounted in the accommodation portion 33 without rattling around. The CPU detects the ON condition of the detection switch 61. When the ON condition is not detected, no drive signals will be outputted from the CPU to the drive circuit. For this reason, recording can be performed when the ink cartridge 50 is accurately mounted.

20 Claims, 5 Drawing Sheets

PRINTER CARRIAGE WITH CONFIGURATION TO INSURE PROPER DETECTION OF INK CARTRIDGE

FIELD OF THE INVENTION

The present invention relates to a carriage of an ink jet recording device. The carriage is provided with an ink jet head for recording by ejecting droplets of ink. A detachable ink cartridge for supplying ink to the ink jet head is mounted on the carriage. The present invention relates to an improvement in detecting presence and mounting condition of the ink cartridge.

RELATED ART

There has been known a conventional ink jet recording device with an accommodation portion for accommodating an ink cartridge. A push switch is provided on a side wall of accommodation portion. When an ink cartridge is mounted in the accommodation portion, the push switch is pressed by the side wall of the ink cartridge. The switch accordingly generates a switching signal for indicating that the ink cartridge is mounted in the accommodation portion. The detection results are displayed on a liquid crystal display provided to the ink jet printer or on the display of a computer connected to the ink jet recording device.

Japanese Patent-Application Publication (Kokai) No. HEI-7-246716 discloses a configuration for mounting an ink cartridge onto a carriage of a printing device. The configuration includes an ink cartridge accommodation case provided on the carriage. A lever formed with a pinion is pivotably attached to the accommodation case. A rack for meshingly engaging with the pinion is formed on the ink cartridge. The free end of the lever is provided with a grip portion for engaging with the upper edge of the other side wall of the accommodation case. To mount the ink cartridge in the accommodation case, the user grips the grip portion and pivots and the lever until the grip portion engages with the upper edge of the other side wall of the case. While the lever is being pivoted, the rack and pinion operated to move the ink cartridge into the accommodation case.

SUMMARY OF THE INVENTION

However, neither of these configurations enables detection of whether the ink cartridge is accurately mounted or not. That is, with the former configuration, the ink cartridge is detected as being mounted whenever the ink cartridge presses against the switch, even if the ink cartridge is improperly mounted. The configuration described in Japanese Patent-Application Publication (Kokai) No. HEI7-246716 includes no detection means of any kind.

It is an objective of the present invention to provide a configuration that detects presence of an ink cartridge only when the ink cartridge is accurately mounted.

A carriage of an ink jet recording device achieves the above-described objective according to the present invention. The carriage is for transporting a print head and an ink cartridge reciprocally within a recording region. The carriage includes an accommodation portion, a lever member, a detection switch, a switching member, and an abutment member.

The accommodation portion has confronting first and second side walls for accommodating the ink cartridge therebetween. The lever member is pivotably attached to the first wall and pivots in an engagement direction into releasable engagement with the second wall. The detection switch, when switched, indicates that the ink cartridge is accommodated in the accommodation portion. The switching member is for switching the detection switch.

The abutment member abuts against the ink cartridge, which is accommodated between the first and second side walls, when the lever member pivots a predetermined amount in the engagement direction. Pivoting movement of the lever member in the engagement direction beyond the predetermined amount is transmitted to the abutment member by abutment between the abutment member and the ink cartridge. Because the abutment member is in an interlocking condition with the switching member, pivoting movement transmitted to the abutment member is transmitted to the switching member so that the detection switch is switched.

With this configuration, the abutment member abuts the ink cartridge after the lever member has been pivoted a predetermined amount in the direction for engaging it with the first wall. When the lever member is further pivoted, the switching member operates to switch the detection switch because of its interlocked condition with the abutment member. In other words, the switching member will not switch the detection switch unless the abutment member abuts against the ink cartridge. Accordingly, the detection switch will not be switched unless the ink cartridge is accommodated in the accommodation portion. Further, the lever member will not engage with the first wall unless the ink cartridge is properly mounted in the accommodation portion. As a result, recording can be performed while the ink cartridge is properly mounted.

It is desirable to further provide the lever member with a resilient pressing portion for resiliently pressing against the ink cartridge when the lever member pivots the predetermined amount or less than the predetermined amount in the engagement direction. With this configuration, the pressing portion resiliently presses against the ink cartridge whenever the abutment member abuts the ink cartridge. Therefore, unless the lever member properly engages with the second wall, the pressing portion will resiliently urge the lever member to pivot in the opposite direction of the engagement direction, so that the switching member will not be switched. The detection results of the detection switch, which indicate whether or not the ink cartridge is accurately mounted, can be displayed on a liquid crystal display provided to the ink jet printer or can be displayed on the display of the computer connected to the ink jet recording device. Whether or not the ink cartridge is accurately mounted can be known by viewing the display.

Ink jet recording devices often include a circuit board mounted with a drive circuit for driving the ink jet head. The circuit board is often provided near the ink jet head and connected to the ink jet head by wiring. A detection switch for detecting presence of an ink cartridge can be configured to cut off power to the ink jet head when no ink cartridge is detected. When such a detection switch is provided, then wiring for connecting the circuit board with the ink jet head must be run by the detection switch. If the detection switch is located far from the ink jet head, then the wiring becomes longer and costs for producing the ink jet printer increase.

It is therefore desirable that a circuit board, which is mounted with a drive circuit driving the ink jet head, be attached to an outer surface of the first side wall, and the detection switch be attached to the circuit board. Therefore, there is no need to provide wiring from the circuit board to the detection switch so that production costs can be reduced.

When the accommodation portion is adapted to accommodate a plurality of ink cartridges, it is desirable that a separate holding member, detection switch, and switching member be provided for each of the plurality of ink cartridges. With this configuration, whether or not each ink cartridge is accurately accommodated can be independently detected. By displaying each detection result, the user will know which ink cartridges are accurately mounted.

It is also desirable that an urging member be provided for urging the switching member in a direction to separate the switching member from the detection switch. With this configuration, when the lever member is pivoted in a direction opposite from the engagement direction in order to release the engagement condition between the lever member and the second wall, urging force of the urging member will reliably separate the switching member from the detection switch so that the detection switch will be turned off. Accordingly, the detection switch can be accurately put into an OFF condition when an ink cartridge is removed for some reason.

It is desirable that the abutment member and the switching member be integrally formed together and pivotably attached near a pivotal center of the lever member. With this configuration, the functions of both members can be achieved by only a single component. Further, the detection switch can be switched by first pivoting the lever member to where the abutment member abuts the upper surface of the ink cartridge and then further pivoting the lever member so that the switching member pivots around its the pivotal center. A cartridge according to another aspect of the present invention includes an accommodation portion, a holding member, a detection switch, an abutment member, and a switching member. The accommodation portion accommodates the ink jet cartridge between a first and second side walls.

The holding member holds the ink cartridge accommodated in the accommodation portion. Further the holding member includes an end, another end and a pressing portion. The end pivotably is attached to an upper edge of the first side wall. The another end detachably engages with the second side wall when the holding member pivots around the end in an engagement direction. The pressing portion is provided between the end and the another end. The pressing portion presses downward on an upper surface of the ink cartridge accommodated in the accommodation portion when the another end is engaged with the second wall.

The detection switch is provided near an upper end of an outer surface of the first side wall. The detection switch switches to detect whether the ink cartridge is accommodated in the accommodation portion.

The abutment member abuts an upper surface of the ink cartridge when the holding member pivots in the engagement direction to engage the another end with the second side wall.

The switching member is interlocked with the abutment member and operates to switch the detection switch when pivoting of the holding member in the direction proceeds after the abutment member is brought into an abutment condition with the upper edge of the ink cartridge.

BRIEF DESCRIPTION OF THE DRAWINGS

The above and other objects, features and advantages of the invention will become more apparent from reading the following description of the preferred embodiment taken in connection with the accompanying drawings in which.

DETAILED DESCRIPTION OF A PREFERRED EMBODIMENT

Figure 1:
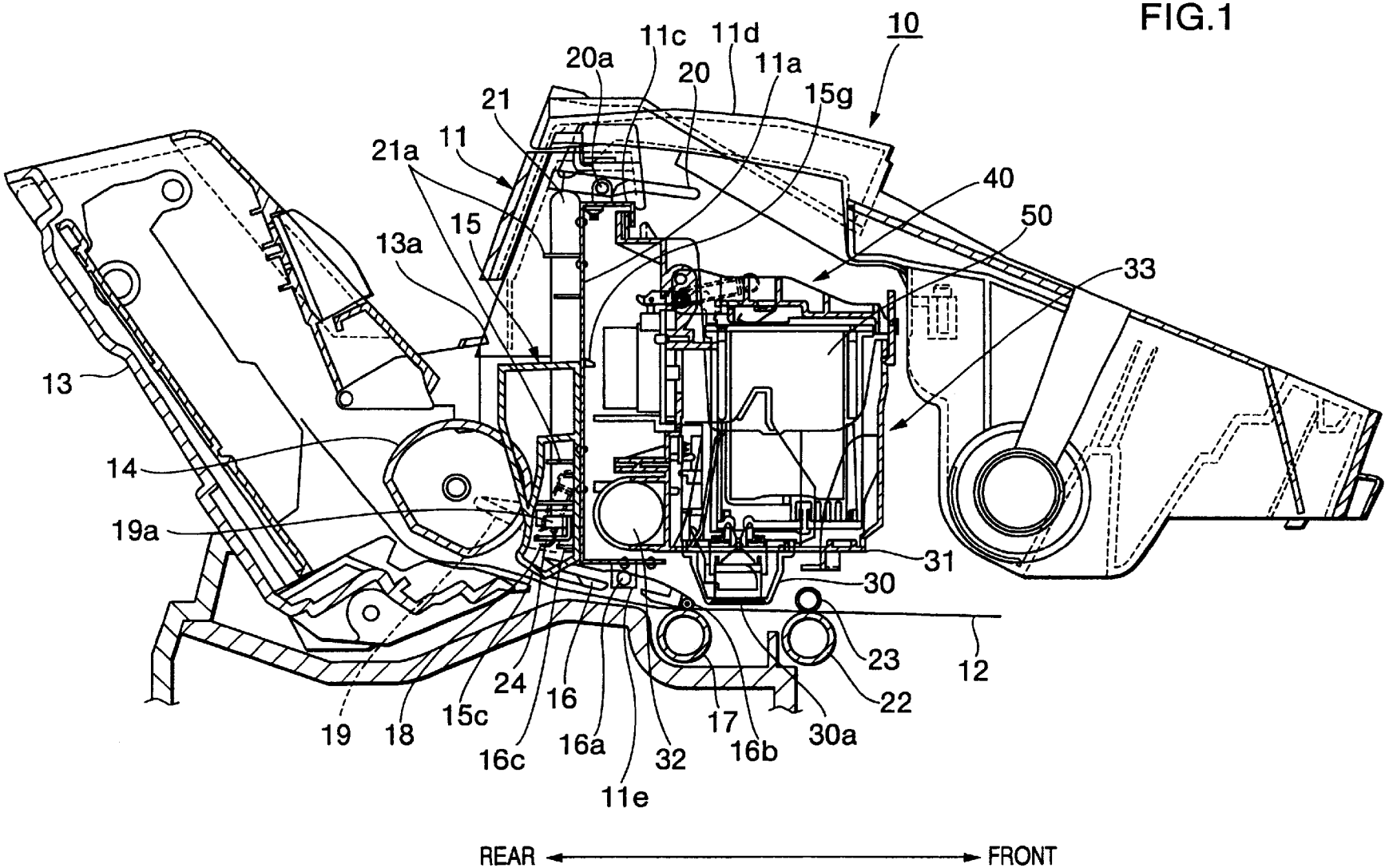
FIG. 1 is a cross-sectional view showing internal configuration of a recording device according to an embodiment of the present invention.

An ink jet recording device according to the preferred embodiment of the present invention will be described while referring to the accompanying drawings wherein like parts and components are designated by the same reference numerals to avoid duplicating description.

The present embodiment describes the present invention applied to a multi-function type recording device 10 provided with a plurality of functions, such as printer, facsimile, and copy functions, as a representative example of an ink jet recording device (referred to as a recording device, hereinafter). Further, the recording device 10 is capable of recording in color using four colored inks of black, yellow, cyan, and magenta.

FIG. 1 is a vertical cross-sectional view showing configuration in the vicinity of a carriage 31 of the recording device 10. It should be noted that directional terms, such as "front," "rear," "left," and "right," used in the following description refer to relative positions of components when the recording device is in the orientation in which it is intended to be used, that is, wherein the right side of FIG. 1 is the front portion of the recording device 10, the left side of FIG. 1 is the rear portion of the recording device 10, and, unless otherwise noted, wherein a clamp lever 40 is engaged with a second side wall 35 in a manner to be described later.

The recording device 10 has a housing 11. A sheet supply cassette 13 is detachably engaged to the rear portion of the housing 11 by a hook 13*a*. The sheet supply cassette 13 is capable of accommodating a plurality of recording sheets 12. A sheet supply roller 14 having a rotational axis following a widthwise direction of the recording sheets 12 is provided near the lower front of the sheet supply cassette 13.

A plate-shaped partition member 11*a* is formed in front of the sheet supply roller 14 within the housing 11 so as to extend vertically from a lower surface to an upper surface of the housing 11. A protective cover 15 is attached to the rear surface of the partition member 11*a*. A first guide member 15*c* is formed by the lower surface of the protective cover 15 in front of the supply roller 14 so that the front edge of recording sheets 12 transported by the sheet supply roller 14 will abut the first guide member 15*c* and be guided forward. A pawl 15*g* for engaging the partition member 11*a* is formed in the upper front edge of the protective cover 15. The pawl 15*g* detachably holds the protective cover 15 to the partition member 11*a*.

A second guide member 16 is provided in the front of the first guide member 15*c*. The second guide member 16 has a shaft member 16*a* formed at its substantial center. The shaft member 16*a* is pivotably disposed in a support portion 11*e* provided to the lower edge of the partition member 11*e*. With this configuration, the second guide member 16 is freely pivotable about the shaft member 16*a*.

A pressing roller 16*b* is rotatably disposed in the front tip of the second guide member 16. A sheet feed roller 17 is disposed below, and in confrontation with, the pressing roller 16*b*. A spring 18 accommodated in the protective cover 15 is engaged at one end with the rear end of the second guide member 16 and at the other end to the lower end of the partition member 11*a*. The spring 18 urges the second guide member 16 in the clockwise direction as viewed in FIG. 1 so that the pressing roller 16*b* is maintained in pressing contact against the sheet feed roller 17.

The second guide member 16 has a protrusion portion 16*c* formed at its rear end. A first release lever 19 is attached at its rear end to a reverse L-shaped clasp 24 disposed above the protrusion portion 16*c*. The first release lever 19 is provided pivotable about a bolt 19*a* so that when the front end of the first release lever 19 is pulled upward, the first release lever 19 pivots in the clockwise direction around the bolt 19*a*. At this time, the end of the first release lever 19 presses the second guide member 16 downward via the clasp 24. As a result, the second guide member 16 pivots counterclockwise around the shaft member 16*a*, so that the pressing roller 16b separates from the sheet feed roller 17. With this configuration, a recording sheet 12 sandwiched between the sheet feed roller 17 and the pressing roller 16*b* can be removed to correct paper jams.

The partition member 11*a* is formed at its upper end with an attachment member 11*c*, at a position exposed when a cover 11*d* is opened. A bolt 20*a* attached on the attachment member 11*c*. A second release lever 20 is disposed above the attachment member 11*c* so as to be pivotable around the bolt 20*a*. An elongated rod-shaped link member 21 spans between the rear end of the second release lever 20 and the upper end of the clasp 24. The link member 21 penetrates through the upper portion of the protective cover 15 and also is supported by the partition member 11*a* via holding members 21*a*, 21*a*. The link member 21 is movable in a vertical direction through the holding members 21*a*, 21*a*.

When the front end of the second release lever 20 is pulled upward, the second release lever 20 pivots in the counterclockwise direction around the bolt 20*a*. The rear end of the second release lever 20 pushes the link member 21 down. The link member 21 presses the clasp 24 downward accordingly. When the clasp 24 is pressed downward, the rear end of the second guide member 16 is pressed downward, the second guide member 16 pivots in the counterclockwise direction around the shaft member 16*a*, and the pressing roller 16*b* separates from the upper surface of the sheet feed roller 17. That is to say, by opening the cover 11*d* and manipulating the second release lever 20, paper jams between the sheet feed roller 17 and the second guide member 16 can be corrected without removing the sheet supply cassette 13.

A guide shaft 32 is disposed in the widthwise direction of the recording device 10. A carriage 31 is mounted on the guide shaft 32 so as to be reciprocally movable following the guide shaft 32. An ink jet head 30 is detachably mounted on the carriage 31. A plurality of ink chambers attached with piezoelectric elements are formed in the ink jet head 30. By applying a voltage to the piezoelectric elements, the volume of the ink chambers changes and ink droplets are ejected onto a recording sheet 12 from nozzles formed in the ink chambers.

Discharge rollers 22, 23 for discharging printed-on recording sheets 12 from a recording sheet discharge port (not shown) are rotatably disposed above the ink jet head 30.

Next, an explanation will be provided for supply of the recording sheet 12, recording operations, and discharge of the recording sheet 12.

First, a recording sheet 12 accommodated in the sheet supply cassette 13 is transported toward the first guide member 15*c* by the sheet supply roller 14 rotating in the clockwise direction. The recording sheet 12 is guided to the second guide member 16 by the first guide member 15*c*. Next, the recording sheet 12 guided by the second guide member 16 passes between the sheet feed roller 17 and the pressing roller 16*b* and is transported to the ink jet head 30.

Rotation of the sheet feed roller 17 is stopped when the first recording position of the recording sheet 12 reaches the recording surface 30*a*. Then, the ink jet head 30 is driven and the carriage 31 is reciprocally moved within a recording region following the guide shaft 32. The ink jet head 30 performs recording by ejecting ink droplets onto the recording sheet 12. Next, when a single line's worth of printing is completed, the sheet feed roller 17 is rotated by a predetermined amount and the recording sheet 12 is fed to the next recording position and the same above-described recording operations are performed.

Afterward, the same above-described recording and sheet feed operations are repeated and the recording sheet 12 is discharged from the recording sheet discharge port (not shown) by passing through the discharge rollers 22, 23.

Figure 2:
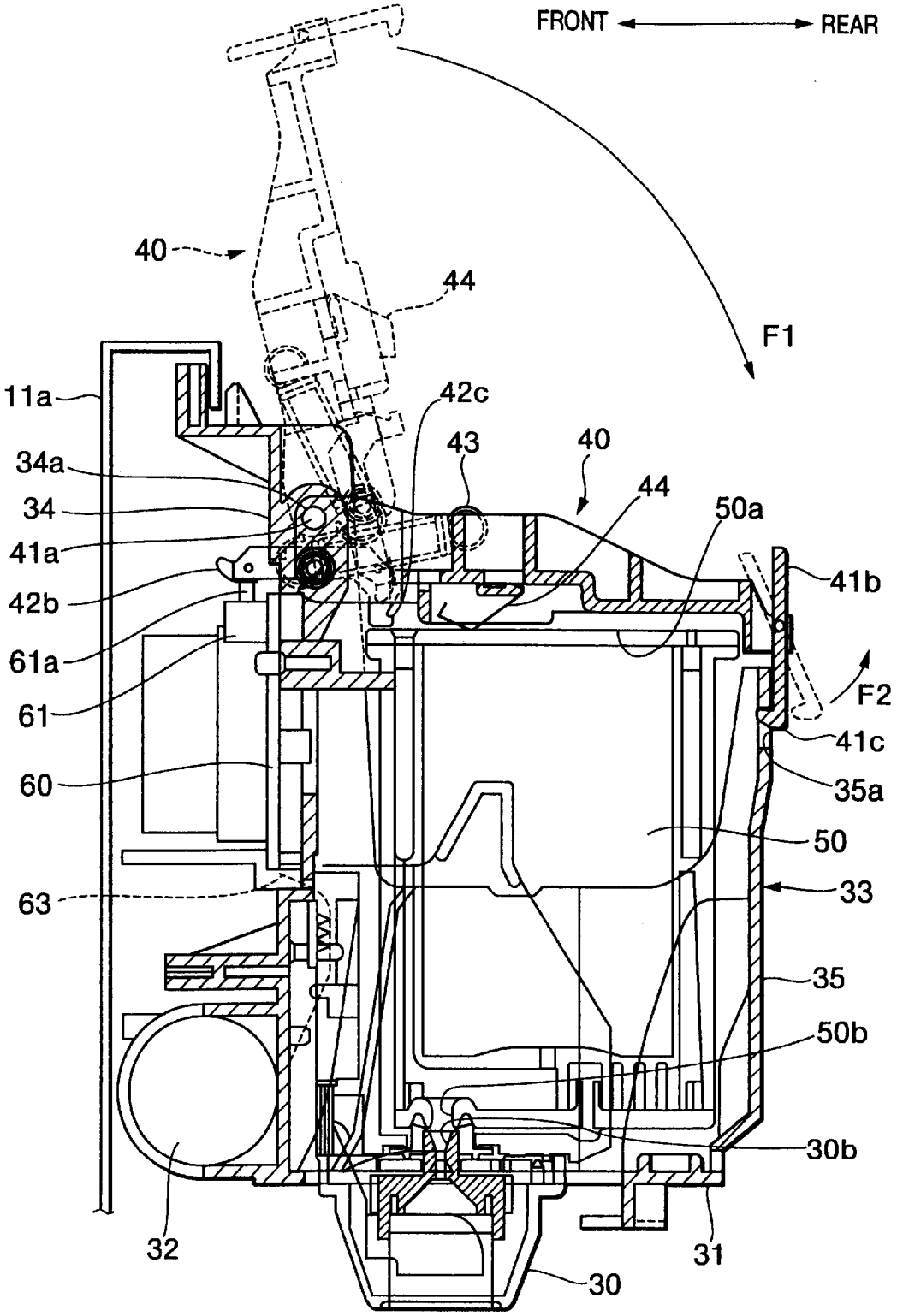
FIG. 2 is an enlarged cross-sectional view showing configuration around an ink cartridge accommodation portion in the recording device shown in FIG. 1.
Figure 3:
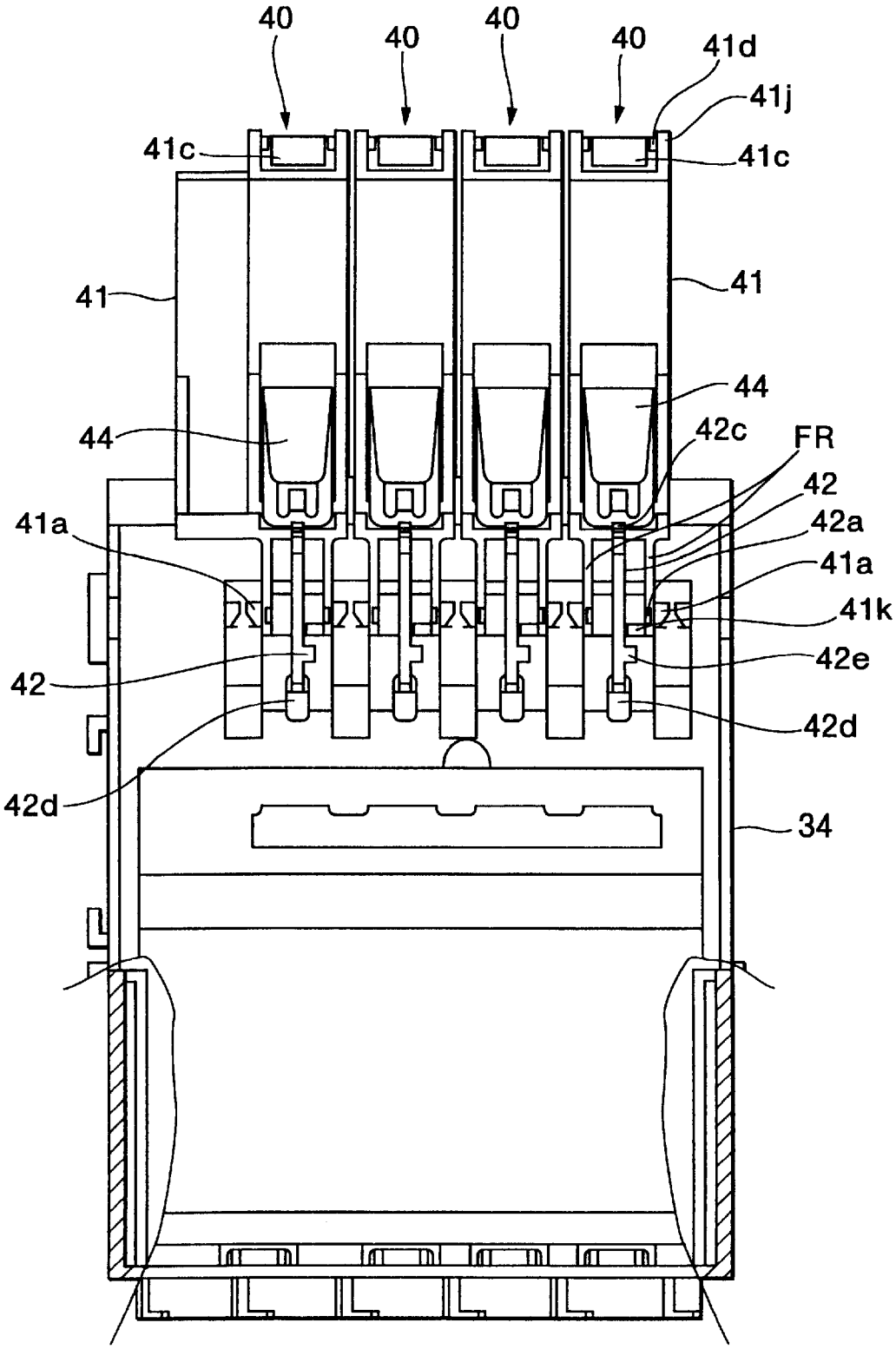
FIG. 3 is a side view showing the ink cartridge accommodation portion of FIG. 2 while a clamp lever is in an upright posture indicated by the broken line in FIG. 2.
Figure 4:
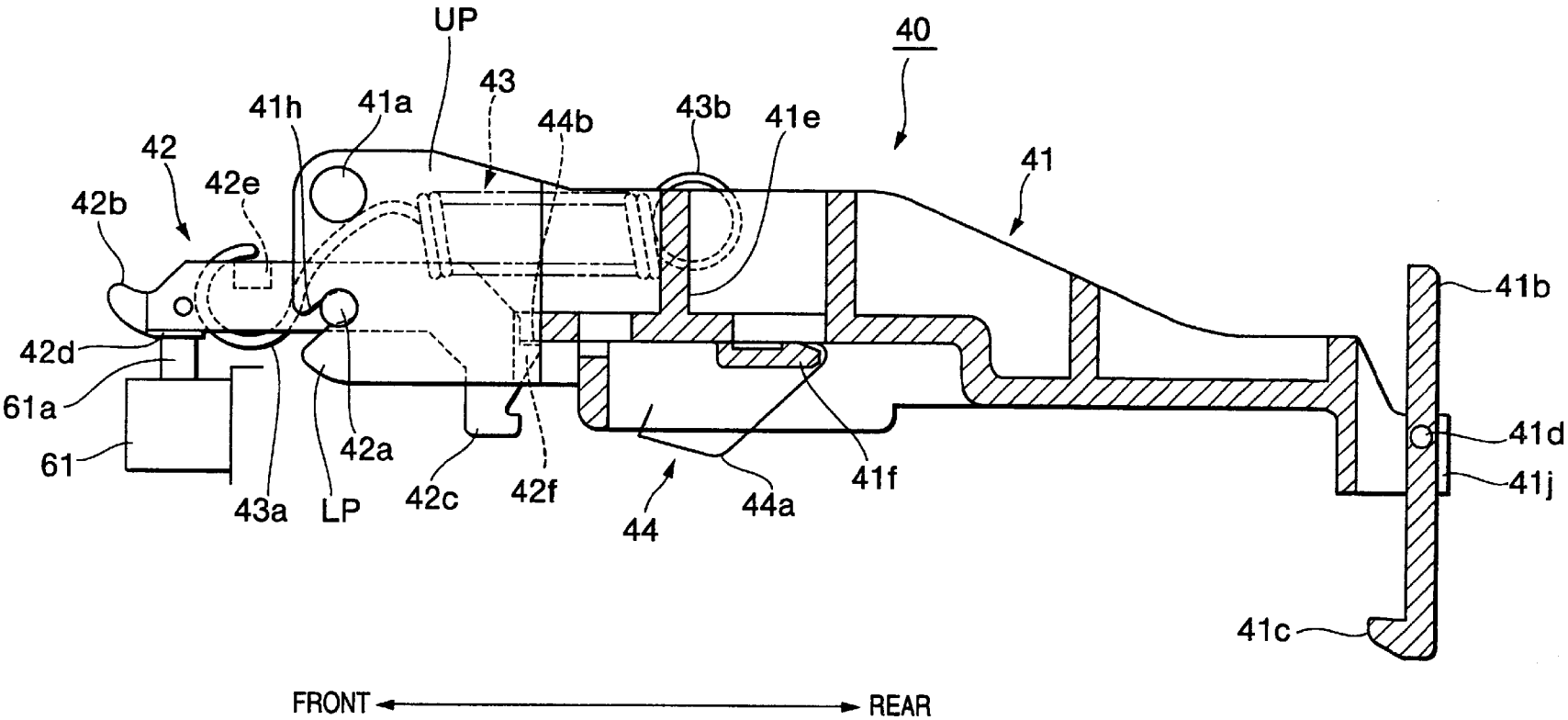
FIG. 4 is an enlarged cross-sectional view of the clamp lever shown in FIG. 2.

Next, while referring to FIGS. 2 to 4, an explanation will be provided for configuration for detecting presence and mounting condition of an ink cartridge 50 on the carriage 31, which is provided to the recording device shown in FIG. 1. FIG. 2 is a vertical cross-sectional view showing the ink cartridge 50 mounted on the carriage 31. FIG. 3 is a side view of the configuration shown in FIG. 2, with clamp levers in an upright posture indicated for a representative claim lever 40 by a broken line in FIG. 2. FIG. 4 is a cross-sectional view showing details of the representative the clamp lever 40.

As shown in FIG. 2, the carriage 31 includes a box-shaped accommodation portion 33 for accommodating the ink cartridge 50. The accommodation portion 33 has a first and second vertically-extending side walls 34, 35, disposed in confrontation with each other, for accommodating the ink cartridge 50 therebetween. The first side wall 34 is formed at the guide shaft 32 side of the carriage 31. Shaft through holes 34*a* are formed in the upper end of the first side wall 34. An engagement hole 35*a* is formed in the upper end of the second side wall 35.

Since all of the clamp levers 40 have similar configuration, further explanation will be provided with respect to the representative clamp lever 40 shown in FIGS. 2 and 4. The clamp lever 40 is formed with shaft members 41*a* at its front end and a hook lever 41*b* at its rear end. The shaft members 41*a* are pivotably inserted into the shaft through holes 34*a*, so that the clamp lever 40 is pivotably disposed above the accommodation portion 33. A hook 41*c* is formed at the lower tip of the hook lever 41*b*. The hook 41*c* engages with the engagement hole 35*a*. As will be described in fuller detail later, the ink cartridge 50 can be accurately mounted in the accommodation portion 33 by pivoting the clamp lever 40 around the shaft members 41*a* in a direction indicated by an arrow F1, from the condition shown by the broken line in FIG. 2 to the condition shown by the solid line in FIG. 2, until the hook 41*c* of the hook lever 41*b* engages in the engagement hole 35*a*.

Figure 5:
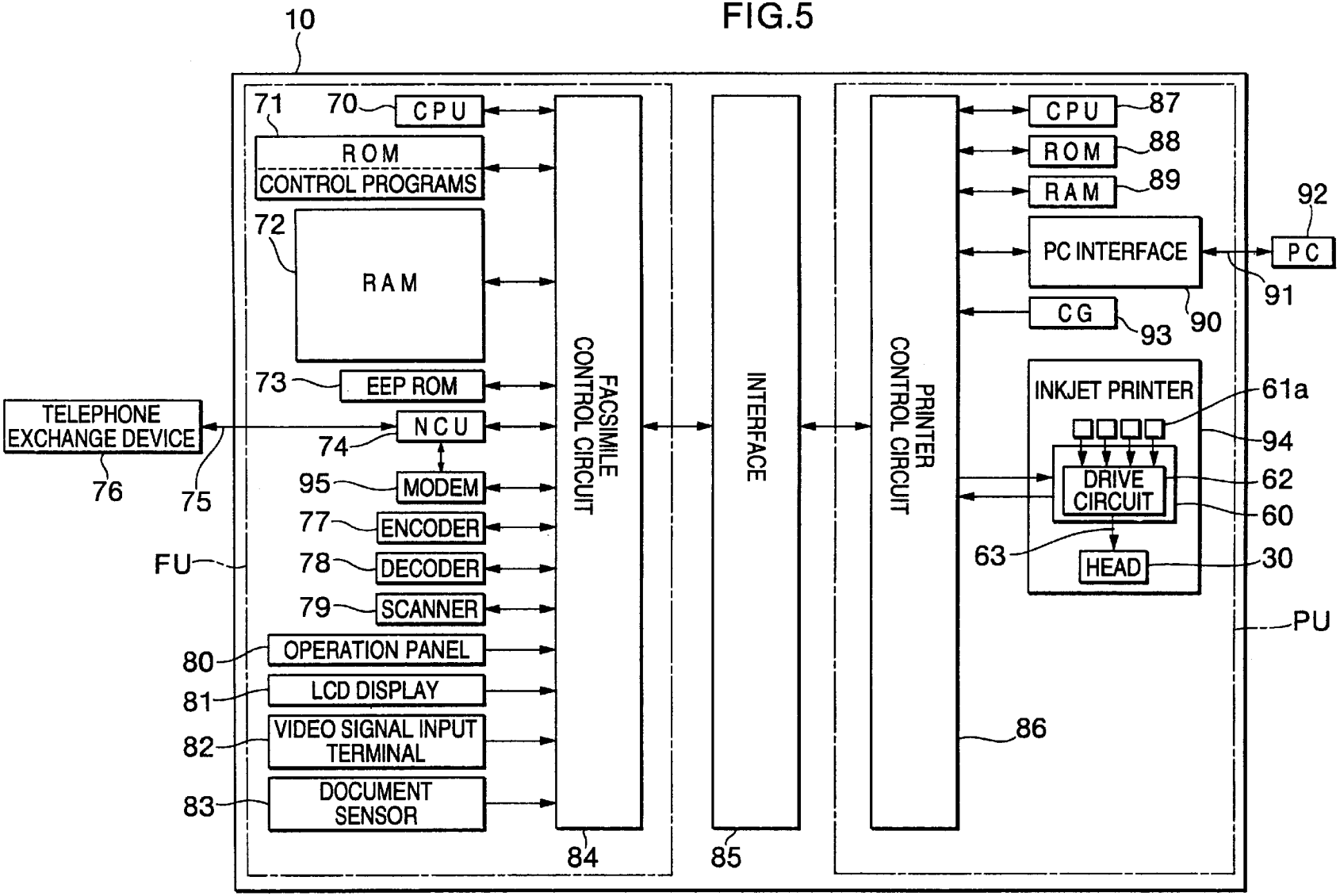
FIG. 5 is a block drawing showing main electrical configuration of the recording device shown in FIG. 1.

A circuit board 60 is attached to the outer surface of the first side wall 34. A drive circuit 62 shown in FIG. 5 is mounted on the circuit board 60. The drive circuit 62 is for driving the ink jet head 30. A detection switch 61 is attached at the upper end of the circuit board 60. The detection switch 61 is for detecting whether the ink cartridge 50 is properly mounted in the accommodation portion 33. A vertically movable button 61*a* protrudes from the upper surface of the detection switch 61. When the button 61*a* is pushed down, contacts in the detection switch 61 contact each other to turn the detection switch 61 ON. When the button 61*a* rises up, the contacts separate and the detection switch 61 turns OFF. A flexible printer circuit (FPC) 63 is connected to and extends from the lower end of the circuit board 60. The flexible printer circuit 63 electrically connects a variety of circuits mounted on the circuit board 60 to, for example, the print head 30.

Next, detailed configuration of the clamp lever 40 will be described while referring to FIGS. 3 and 4. It should be noted that the left side of FIG. 4 is the front end of the clamp lever 40 and the right side of FIG. 4 is the rear end of the clamp lever 40.

As shown in FIG. 3, four clamp levers 40 are each pivotably attached to the first side wall 34. Each of the four clamp levers 40 is for mounting an ink cartridge containing a different colored ink, that is, from left to right in FIG. 2, for mounting a black ink cartridge, a yellow ink cartridge, a cyan ink cartridge, and a magenta ink cartridge. The black ink cartridge has a larger volume than the other ink cartridges because black ink is consumed in greater amounts than the other colored inks. Therefore, the black ink cartridge has a greater surface area at its upper surface than the other ink cartridges. Consequentially, the leftwardmost clamp lever 40 has a broader width than the other three clamp levers.

The representative clamp lever 40 has a main body 41 formed with confronting front ribs FR extending from its front end and confronting attachment ribs 41*j* extending from its rear end. As shown in FIG. 4, each front rib FR includes an angular upper portion UP and an angular lower portion LP. One shaft member 41*a* protrudes outward from each of the upper portions UP and is inserted into a corresponding through hole 34*a*, so that the clamp lever 40 is pivotable with respect to the first side wall 34 as described above. Substantially U-shaped notched portions 41*h* are formed in the rear end of the main body 41 near the lower portion LP.

The hook lever 41*b* is disposed in a vertical posture between the attachment ribs 41*j*. The hook lever 41*b* is integrally formed with two shaft members 41*d*, one near the center of each side surface. Each shaft member 41*d* is also integrally connected with an inner surface of one of the attachment ribs 41*j*. In other words, the substantial center of each side surface of the hook lever 41*b* and the corresponding inner surfaces of the attachment ribs 41*j* are integrally connected by the shaft members 41*d*. The hook 41*c* is formed in the lower end of the hook lever 4l*b* so as to curve toward the front of the recording device.

The clamp lever 40 according to the present embodiment is formed from a compound resin, and the shaft members 41*d* of the hook lever 41*b* is formed slim enough to provide the hook lever 41*b* with resiliency at the position formed integrally with the shaft members 41*d*. Therefore, as shown by the broken line in FIG. 2, the hook lever 41*b* can pivot in the direction indicated by the arrow F2. With this configuration, the hook 41*c* is capable of detachably engaging the engaging hole 35*a*, which is formed in the upper end of the first side wall 34 as described previously. Also, restitutive force of the hook lever 41*b* maintains the hook 41*c* in an engagement condition with the engagement hole 35*a*.

A switch lever 42 is disposed between the front ribs FR of the main body 41. The switch lever 42 is formed with outward protruding shaft members 42*a* near its substantial center. The shaft members 42*a* are pivotably inserted into corresponding ones of the notched portions 41*h*. A spring 43 is connected between the switch lever 42 and the main body 41 of the clamp lever 40. That is, the spring 43 has one hook 43*a* engaged in front of the shaft members 42*a* of the switch lever 42 and another hook 43*b* engaged with a partition wall 43*b* formed between confronting sides of the main body 41. With this configuration, compression force of the spring 43 urges the switch lever 42 to pivot in the clockwise direction around the shaft members 42*a*.

The switch lever 42 includes a front end 42*b* and an abutment member 42*c* at its rear end. The front end 42*b* protrudes beyond the front end of the main body 41. An abutment surface 42*d* is formed at the lower surface of the front end 41*b*. The abutment surface 42*d* is for abutting against the upper surface of the button 61*a* of the detection switch 61 to press down the button 61*a*.

The abutment member 42*c* is formed to protrude downward from below the rear end of the switch lever 42. The abutment member 42*c* abuts an abutment surface 50*a* of the ink cartridge 50 when, as shown in FIG. 2, the clamp lever 40 is pushed over in the direction of the arrow F1 and the clamp lever 40 approaches a horizontal posture.

A plate spring 44 is provided in the substantial center at the lower surface of the main body 41 of the clamp lever 40. The upper portion of the plate spring 44 is held in place by a resilient sandwiching member 41*f*, which is formed in the interior of the main body 41. The plate spring 44 has an angular shape, with a lower apex portion 44*a* formed at one of the angles. The lower apex portion protrudes below the bottom surface of the main body 41 and also protrudes lower than the abutment member 42*c*.

The lower apex portion 44*a* of the plate spring 44 abuts against the abutment surface 50*a* of the ink cartridge 50 when, as shown in FIG. 2, the clamp lever 40 is pushed over in the direction of the arrow F1 and approaches a horizontal posture. When the hook 41*c* of the hook lever 44 of the clamp lever 40 engages with the engagement hole 35*a* of the second side wall 35, restitutive force of the plate spring 44 presses down on the ink cartridge 50, thereby accurately and securely mounting the ink cartridge 50 in the accommodation portion 33. The ink cartridge 50 will therefore not rattle around in the accommodation portion 33.

Here, configuration will be described for setting the upright posture of the switch lever 42 indicated by the broken line in FIG. 3, and preventing the switch lever 42 from exceeding its dead center with respect to the spring 43. A protrusion portion 42*e* is formed on a side surface near the front end of the switch lever 42. A regulating portion 41*k* for abutting against the protrusion portion 42*e* is formed on an inner surface of one front rib FR of the main body 41. More specifically, the regulating portion 41*k* is formed on the protrusion portion 42*e* at a position along an orbit defined by the protrusion portion 42*e* when the front end 42*b* pivots in the counterclockwise direction as viewed in FIG. 2. The regulating portion 41*k* is positioned where it will abut against the protrusion portion 42*e* to regulate the switch lever 42 from pivoting excessively beyond its upright posture.

As mentioned previously, compression force of the spring 43 urges the switch lever 42 to pivot in the clockwise direction around the shaft members 42*a*. As a result, without provision of the regulating portion 41*k* and the protrusion portion 42*e*, compression force of the spring 43 would pull the switch lever 42 to pivot beyond the upright posture and past the dead center of switch lever 42, whereupon the spring 43 would begin to urge the switch lever 42 to pivot in the counterclockwise direction. As a result, the abutment member 42*c* would be raised up and consequently will not abut against the upper abutment surface 50*a* of the ink cartridge 50. The button 61*a* of the detection switch 61 will not be pressed down. Further, the front end 42*b* of the switch lever 42 will bump against the button 61*a* so that the clamp lever 40 can not be properly closed.

The switch lever 42 is provided with a stopper 42*f* for preventing the clamp lever 40 from pivoting beyond a predetermined horizontal posture in the clockwise direction as viewed in FIG. 4. The clamp lever 40 is provided with an abutment portion 44*b*. Normally, the stopper 42*f* and the abutment portion 44*b* are separated by a small gap as shown in FIG. 4. However, when the user accidentally presses the clamp lever 40 downward too strongly, the stopper 42*f* abuts against the abutment portion 44*b*, thereby preventing the clamp lever 40 from being forced too deeply into the accommodation portion 33.

Next, main electrical configuration of the recording device 10 will be explained while referring to the block diagram shown in FIG. 5.

The recording device 10 is provided with a facsimile unit FU and a print unit PU. The facsimile unit FU is provided with a facsimile control circuit 84 and the print unit PU is provided with a printer control circuit 86. Both the facsimile control circuit 84 and the printer control circuit 86 are connected to an interface 85, so that the facsimile unit FU and the print unit PU are connected to each other.

The facsimile control circuit 84 of the facsimile unit FU is connected to a variety of components, such as a CPU 70 for executing, for example, control of reception and transmission of data; a ROM 71 for storing control programs for the CPU 70 to execute a variety of controls; a RAM 72 for temporarily storing, for example, data retrieved from a document by an image scanner 79; and an EEPROM 73 for rewritably storing facsimile numbers and the like.

A network control unit (NCU) 74 is provided for responding to call signals from a telephone line 75 and transmitting dial signals to the telephone line 75. A modem 94 for performing reception and transmission of retrieved data is connected to the NCU 74. Further, the facsimile control circuit 84 is connected to an encoding device 77 for encoding, for example, data retrieved by the image scanner 79 into compressed data; a decoding device 78 for decoding encoded data, such as received retrieval data; and a document sensor 83 for detecting that a document is set in the document set portion.

The printer control circuit 86 of the print unit PU is for controlling the ink jet printer 94. The printer control circuit 86 is connected to a variety of components, including a CPU 87 for executing programs for controlling the ink jet printer 94; a ROM storing programs and the like for execution by the CPU 87; a RAM having a print memory storing recording data and a work memory used while the CPU 87 is operating; a PC interface 90 connected to the personal computer (PC) 92; a character generator (CG) 93 storing vector fonts, such as for characters to be recorded; and the ink jet printer 94 for printing by ejecting ink droplets onto a recording sheet. It should be noted that in the present embodiment, the PC interface 90 is a parallel interface in compliance with Centronics standard. The recording device 10 transmits and receives data with the PC 92 over a cable 91 connected to the PC interface 90.

The ink jet printer 94 includes the ink jet head 30 shown in FIG. 2, the driving circuit 62 for driving the ink jet head 30, and four detection switches 61*a* each provided for a different one of the ink cartridges. A switching signal generated from each detection switch 61*a* is outputted from the circuit board 60 to the printer control circuit 86 and detected by the CPU 87. In other words, the CPU 87 detects whether or not the ink cartridge 50 is accommodated in the accommodation portion 33.

Next, an explanation will be provided for a series of operations performed from when the ink cartridge 50 is mounted in the recording device 10 until when recording is performed on the recording sheet 12.

First, an explanation will be provided for when the ink cartridge 50 is accommodated in the accommodation portion 33. As shown in FIG. 2, an ink inlet 30*b* is formed in a protruding shape at the upper side of the ink jet head 30. Also, an ink outlet port 50*b* is provided at the lower surface of the ink cartridge 50. When the ink cartridge 50 is accommodated in the accommodation portion 33, then, as shown in FIG. 2, the ink inlet 30*b* is inserted into the ink outlet port 50*b* so that the ink outlet port 50*b* and the ink inlet 30*a* come into fluid communication with each other and ink within the ink cartridge 50 is supplied to the ink jet head 30.

When the clamp lever 40 is pushed over from its upright posture indicated by the broken line in FIG. 2, in a direction indicated by the arrow F1, then the clamp lever 40 pivots in the direction of the arrow F1 around the shaft members 41*a*. When the clamp lever 40 approaches its horizontal posture, first the lower apex portion 44*a* of the plate spring 44, and then the lower surface of the abutment member 42*c*, abut the upper surface 50*a* of the ink cartridge 50 in this order. Alternatively, the plate spring 44 and the abutment member 42*c* can be configured so that the two abut against the upper surface 50*a* of the ink cartridge 50 at the same time.

When the clamp lever 40 is pivoted further in the direction of the arrow F1 against the resilient force of the plate spring 44, then abutment between the abutment member 42*c* and the upper surface 50*a* transmits pivoting force of the clamp lever 40 to the switch lever 42, so that the switch lever 42 pivots against the compression force of the spring 43 in the counterclockwise direction around the shaft members 42*a*. As the switch lever 42 pivots in the counterclockwise direction, the abutment surface 42*d* formed on the lower surface of the front end 42*b* of the switch lever 42 is brought into abutment with the upper surface of the button 61*a* of the detection switch 61.

When the clamp lever 40 is pivoted still further, the hook 41*c* engages in the engagement hole 35*a* by resilient force of the hook lever 41*b*. At this time, the switch lever 42 pivots further in the counterclockwise direction and the abutment surface 42*d* presses the button 61*a* of the detection switch 61 downward. As a result, the detection switch 61 turns on. Also, the lower apex portion 44*a* of the plate spring 44 presses down on the upper surface 50*a* of the ink cartridge 50.

When the detection switch 61 is turned ON, the detection switch 61 generates a switching signal indicating the ON condition of the detection switch 61. The switching signal is outputted from the circuitry mounted on the circuit board 60 to the printer control circuit 86, and then outputted from the printer control circuit 86 to an input port of the CPU 87. The CPU 87 detects the ON condition of the detection switch 61 and sets a detection flag accordingly.

It should be noted that the CPU 87 only outputs a drive signal to the driving circuit 62 when ON switching signals are detected for all four of the detection switches 61 provided in correspondence with the four ink cartridges. That is to say, when even one of the four color ink cartridges 50 is not accommodated in an accommodation portion 33, the CPU 87 controls to not perform recording. This prevents the ink jet head from performing idle printing.

Next, operations for replacing an empty ink cartridge 50 that has run out of ink will be described. As shown in FIG. 2, engagement between the hook 41*c* and the engagement hole 35*a* is released by pivoting the upper end of the hook lever 41*b* in the direction indicated by the arrow F2. Then, the clamp lever 40 is pivoted open to the position indicated by the broken line in FIG. 2. Afterward, the ink cartridge 50 is removed.

Because compression force of the spring 43 urges the switch lever 42 to pivot in the clockwise direction, when the clamp lever 40 is pivoted open, then the abutment surface 42*d* of the switch lever 42 separates from the upper surface of the button 61*a*. Accordingly, the button 61*a* rises upward and the detection switch 61 turns OFF. The OFF condition of the detection switch 61 is detected by the CPU 87 and drive of the ink jet head 30 is prohibited.

According to the recording device 10 of the present embodiment, when no ink cartridge 50 is accommodated in the accommodation portion 33, there will nothing for the abutment member 42*c* to abut against. Therefore, the pivoting movement of the clamp lever 40 will not be transmitted to the detection switch 61 unless an ink cartridge 50 is accommodated in the accommodation portion 33. In other words, the detection switch 61 will not turn on, and recording operations can not be performed, unless the ink cartridge 50 is accommodated in the accommodation portion 33.

Because the plate spring 44 urges the clamp lever 40 to open by pressing against the ink cartridge 50, even when the ink cartridge 50 is accommodated in the accommodation portion 33, the detection switch 61 will not turn on unless the clamp lever 40 is pushed over and the hook 41*c* engaged. Because recording can be performed only when all of the ink cartridges 50 are accurately mounted, it can be instantly known that the ink cartridge 50 is not accurately mounted if recording can not be performed.

Also, because the detection switch 61 is provided on the circuit board 60, there is no need to wire the FPC 63 via the detection switch. Such a configuration would be necessary, if a detection switch for cutting off power to the head when no ink cartridge is present were provided on the first side wall 34 of the accommodation portion 33. Because there is no need to wire the FPC 63 via the detection switch, manufacturing costs can be reduced.

According to the above-described embodiment, a recording device capable of performing color recording using four color ink cartridges was representatively described. However, for example, the above-described configuration can be designed with only a clamp lever 40 for mounting a black ink cartridge because black ink is consumed in great amounts and the black ink cartridge needs to be replaced frequently. The detection switch 61 can be provided at a position corresponding to the switch lever 42 of this lever member 40.

Also, according to the above-described embodiment, a configuration was explained wherein a detection switch was provided for each of four ink cartridges 50. However, a single detection switch 61 can be provided for use for all four of switch levers 42.

Further, the switch lever 42, which pivots in an interlocking manner with pivoting of the clamp lever 40, was described as an integral configuration. However, the front end and rear end of the switch lever 42 could be formed from separate members disposed so that the front end moves in an interlocking manner with movement of the rear end.

Also, the detection switch 61 was described in the embodiment as a push type detection switch. However, the detection switch could instead be configured from a set of positive and negative contact points where the detection switch 61 is located and a conductive member for short circuiting the set of contact points on the lower surface of the abutment surface 42*d* of the switch lever 42. Alternatively, a switch could be disposed on the plate spring 44 so that the switch will turn ON when the plate spring 44 presses down on the abutment surface 50*a* of the ink cartridge 50 and the plate spring 44 bends as a result. Further, a push type switch could be provided to the lower surface of the clamp lever 40.

What is claimed is:

1. A carriage of an ink jet recording device, the carriage transporting a print head and an ink cartridge reciprocally within a recording region, the carriage comprising:

an accommodation portion having confronting first and second side walls for accommodating the ink cartridge therebetween;

a lever member pivotably attached to the first wall and pivoting in an engagement direction into releasable engagement with the second wall;

a detection switch for, when switched, indicating that the ink cartridge is accommodated in the accommodation portion;

a switching member for switching the detection switch; and an abutment member for, when the lever member pivots a predetermined amount in the engagement direction, abutting against the ink cartridge accommodated between the first and second side walls, pivoting movement of the lever member in the engagement direction beyond the predetermined amount being transmitted to the abutment member by abutment between the abutment member and the ink cartridge, the abutment member being in an interlocking condition with the switching member so that pivoting movement transmitted to the abutment member is transmitted to the switching member to switch the detection switch.

2. A carriage as claimed in claim 1, further comprising a resilient pressing portion provided on the lever member and for resiliently pressing against the ink cartridge when the lever member pivots the predetermined amount or less than the predetermined amount in the engagement direction.

3. A carriage as claimed in claim 2, wherein the detection switch is disposed exterior to the accommodation portion near the first wall.

4. A carriage as claimed in claim 2, further comprising a circuit board attached to an outer surface of the first side wall and mounted with a drive circuit driving the ink jet head, the detection switch being attached to the circuit board.

5. A carriage as claimed in claim 4, wherein:

the accommodation portion is adapted to accommodate a plurality of ink cartridges; and a separate lever member, detection switch, and switching member are provided for each of the plurality of ink cartridges.

6. A carriage as claimed in claim 5, further comprising an urging member for urging the switching member to separate from the detection switch, with respect to orientation when the lever member is in releasable engagement with the second wall.

7. A carriage as claimed in claim 6, wherein the abutment member and the switching member are integrally formed together and pivotably attached near a pivotal center of the lever member.

8. A carriage as claimed in claim 2, wherein:

the accommodation portion is adapted to accommodate a plurality of ink cartridges; and a separate lever member, detection switch, and switching member are provided for each of the plurality of ink cartridges.

9. A carriage as claimed in claim 2, further comprising an urging member for urging the switching member to separate from the detection switch, with respect to orientation when the lever member is in releasable engagement with the second wall.

10. A carriage as claimed in claim 9, wherein the urging member urges the abutment member toward the ink cartridge, with respect to orientation when the lever member is in releasable engagement with the second wall.

11. A carriage as claimed in claim 10, further comprising a stopping mechanism for preventing the switching member from exceeding dead center with respect to the urging member, when the lever member is pivoted in a direction opposite the engagement direction.

12. A carriage as claimed in claim 9, wherein the switching member protrudes from the lever member in a direction substantially perpendicular to the first wall, with respect to orientation when the lever member is in releasable engagement with the second wall.

13. A carriage as claimed in claim 12, wherein the switching member is attached to the lever member at a position in between a pivotal axis of the lever member and the first wall, with respect to a direction in which the first wall extends and with respect to orientation when the lever member is in releasable engagement with the second wall.

14. A carriage as claimed in claim 2, wherein the abutment member and the switching member are integrally formed together and pivotably attached near a pivotal center of the lever member.

15. A carriage as claimed in claim 2, further comprising:

a detachable ink jet head for recording by ejecting ink onto a recording medium; and an ink cartridge for supplying ink to the ink jet head.

16. A carriage as claimed in claim 1, wherein the lever member holds the ink cartridge accommodated in the accommodation portion when in engagement with the second wall.

17. A carriage of an ink jet recording device, the carriage transporting an ink cartridge reciprocally within a recording region, the carriage comprising:

an accommodation portion for accommodating the ink jet cartridge between a first and second side walls;

a holding member holding the ink cartridge accommodated in the accommodation portion, the holding member having:

an end pivotably attached to an upper edge of the first side wall;

another end detachably engaging with the second side wall when the holding member pivots around the end in an engagement direction; and a pressing portion provided between the end and the another end, and pressing downward on an upper surface of the ink cartridge accommodated in the accommodation portion when the another end is engaged with the second wall;

a detection switch provided near an upper end of an outer surface of the first side wall, the detection switch switching to detect whether the ink cartridge is accommodated in the accommodation portion;

an abutment member abutting an upper surface of the ink cartridge when the holding member pivots in the engagement direction to engage the another end with the second side wall; and a switching member interlocked with the abutment member, and operating to switch the detection switch when pivoting of the holding member in the direction proceeds after the abutment member is brought into an abutment condition with the upper edge of the ink cartridge.

18. A carriage of an ink jet recording device, the carriage transporting a print head and an ink cartridge reciprocally within a recording region, the carriage comprising:

an accommodation portion having at least a first side wall for accommodating the ink cartridge;

a lever member pivotably attached to the first wall and pivoting in a direction to approach an upper surface of the ink cartridge accommodated in the accommodation portion;

a detection switch for, when switched, indicating that the ink cartridge is accommodated in the accommodation portion;

a switching member for switching the detection switch;

a circuit board attached to a surface of the first side wall and mounted with a drive circuit driving the print head, the detection switch being attached to the circuit board;

an engagement member detachably engaging when the lever member pivots in the direction and keeping the lever member covering the upper surface of the ink cartridge by engagement; and an abutment member for, when the lever member pivots a predetermined amount in the direction, abutting against the ink cartridge accommodated in the accommodation portion, pivoting movement of the lever member in the direction beyond the predetermined amount being transmitted to the switching member to switch the detection switch.

19. A carriage as claimed in claim 18, further comprising a resilient pressing portion provided on the lever member and for resiliently pressing against the ink cartridge when the lever member is set in a posture for covering the upper surface of the ink cartridge.

20. A carriage of an ink jet recording device, the carriage transporting a print head and an ink cartridge reciprocally within a recording region, the carriage comprising:

an accommodation portion having at least a first side wall for accommodating the ink cartridge;

a detection switch for, when switched, indicating that the ink cartridge is accommodated in the accommodation portion;

a circuit board attached to a surface of the first side wall and mounted with a drive circuit driving the print head, the detection switch being attached to the circuit board; and a holding member holding the ink cartridge accommodated in the accommodation portion, pivotably attached to the first wall and pivoting in a direction to approach an upper surface of the ink cartridge in the accommodation portion, the holding member having:

an engagement member detachably engaging when the holding member pivots in the direction and keeping the holding member in a posture of covering the upper surface of the ink cartridge by engagement;

an abutment portion abutting against an upper portion of the ink cartridge accommodated in the accommodation portion when the holding member pivots in the direction to approach the upper surface of the ink cartridge;

a switching member interlocked with the abutment portion, and operating to switch the detection switch when pivoting of the holding member in the direction proceeds after the abutment portion is brought into an abutment condition with the upper portion of the ink cartridge; and a resilient pressing portion resiliently pressing downward on an upper surface of the ink cartridge accommodated in the accommodation portion when the holding member is set in the posture of covering the upper surface of the ink cartridge.

* * * * *